US006014870A

United States Patent [19]

Horner et al.

[11] Patent Number: 6,014,870

[45] Date of Patent: Jan. 18, 2000

[54] DOUBLE POST EARRING

[76] Inventors: Joanne A. Horner; James E. Horner, both of 145 Shoal Creek Rd., Fayetteville, Ga. 30215

[21] Appl. No.: 09/058,498

[22] Filed: Apr. 10, 1998

[51] Int. Cl.[7] ..... A44C 7/00

[52] U.S. Cl. ..... 63/13; 63/12

[58] Field of Search ..... 63/12, 13, 1.16; D11/40, 41

[56] References Cited

U.S. PATENT DOCUMENTS

| | | | |
|---|---|---|---|
| D. 136,958 | 1/1944 | Rubel . | |
| D. 144,198 | 3/1946 | Katz . | |
| D. 264,060 | 4/1982 | Epstein | 63/13 X |
| D. 267,789 | 2/1983 | Winandy . | |
| D. 277,466 | 2/1985 | Chien . | |
| D. 324,350 | 3/1992 | Owens, Jr. . | |
| D. 348,023 | 6/1994 | Horner et al. . | |
| D. 376,768 | 12/1996 | Ross . | |
| 681,934 | 9/1901 | Smith . | |
| 2,208,343 | 7/1940 | Reiter . | |
| 4,086,786 | 5/1978 | Ritter | 63/13 |
| 4,489,572 | 12/1984 | Wilczewski . | |
| 4,741,179 | 5/1988 | McConnell, Jr. . | |
| 4,827,738 | 5/1989 | Rothal . | |
| 4,854,132 | 8/1989 | Blumkin et al. . | |
| 5,018,365 | 5/1991 | Luceno | 63/12 |

*Primary Examiner*—Terry Lee Melius
*Assistant Examiner*—William L. Miller
*Attorney, Agent, or Firm*—Hinkle & Associates, P.C.

[57] ABSTRACT

A double post earring system having a retainer bar assembly 17 comprising a bar 18 having end apertures 19*a* and 19*b*. The retainer bar assembly is positioned to the earlobe 13 by stud assemblies 21*a* and 21*b*, which stud assemblies comprise separate mounting posts 23*a* and 23*b* respectively placed through the apertures 19*a* and 19*b*, and through pierced holes in the earlobe. This system permits the use of relatively heavy ornamentation to be suspended from the retainer bar assembly without damage to the earlobe.

3 Claims, 2 Drawing Sheets

24b
24a
17
18
19b
23b
21b
19a
23a
21a
22a
22b 24b
19b
19b
18
24a
25
18
23a
22a
23b
22b 27b
28b
26
18
27a
28a

DOUBLE POST EARRING

BACKGROUND OF THE INVENTION

I. Field of the Invention

The present invention relates generally to the field of jewelry and, more particularly, to earrings which are designed to alleviate the problem caused to the earlobe when a person wears heavy earrings for a protracted period of time. The wearing of heavy earrings will damage the earlobe over time, by causing the originally pierced hole in the earlobe to elongate and possibly become of such elongated length as to finally tear through the bottom of the lobe.

II. Description of the Related Art

The use of heavy earrings tend to tear the earlobe because there is only one point of contact for the wire or stud which is placed through the pierced hole in the lobe. Originally when the ear is pierced, there is a small hole within the lobe, but it has been found that over time, if a user wears heavy earrings, the original pierced hole will tend to elongate because of the post or wire will act much like a slicing tool, and will tend to tear the lobe in a downward direction and ultimately, over a period of time, may very well tear the lobe completely through. Obviously, such an effect is quite unsightly and may very well be painful to the user. All of this may, out of necessity, require surgery to fix the user's earlobe and, obviously, this could well be expensive and may even not accomplish the desired repair. The problem of the tearing of the earlobe has hindered many women from wearing the earrings they would normally enjoy.

Various forms of double post earrings have been previously devised, but none adequately prevent the tearing of the earlobe as just described.

For instance, in Applicants' previously issued U.S. Pat. No. D-348,023, there is shown a double post which has a solid bar interconnecting two (2) fixed posts, which posts will fit through the earlobe and be connected by the typical friction nut at the rear of the ear. In this particular patent, a large type of earring ornamentation is shown hanging from the retainer bar. However, the retainer bar is fixed to the posts and the elements are not capable of being utilized separately, nor is it capable of being affixed to either side of the earlobe.

In U.S. Pat. No. D-376,768 granted to Ross there is shown a double post earring which has a large depending loop from which a heavier ornamentation may be attached. This earring suffers the same problems as the patent just described to Horner.

The patent to Wilczewski (U.S. Pat. No. 4,489,572) discloses a double post earring having separate posts which may be interconnected by a loop of wire or other material, or may be, in fact, just interconnected between the two posts. However, such a system still does not equalize the forces between the two posts to prevent the tearing of the earlobe.

In the patent to McConnell, Jr., (U.S. Pat. No. 4,741,179) there is shown a multiple post earring structure which does not need separate fastening means to hold the earring in the earlobe. However, this particular system still does not properly address the problem of tearing of the earlobe inasmuch as each element may well tear its separate hole in the lobe.

The patent to Blumkin et al (U.S. Pat. No. 4,854,132) discloses a multiple post earring system which suffers from the same problem as the system shown in Wilczewski, inasmuch as there is no fixed bar between the separate posts to equalize the pressure on the lobe.

SUMMARY OF THE INVENTION

In accordance with the present invention and taking notice of the problems that have existed and continue to exist in the field, it is an objective of this invention to provide a multiple post earring which will equalize the pressure upon the earlobe when the invention is used with heavy earring ornamentation.

It is another object of the invention to provide a multiple post earring which will alleviate the problem of tearing of the earlobe when utilizing heavy earring ornamentation by equalizing the pressure on the earlobe with a fixed retainer bar interconnecting the multiple posts from which the earring ornamentation may be hung.

Yet another object of the invention is to provide a multiple post earring in which the retainer bar interconnecting the multiple posts may be placed either in front of the earlobe or to the rear of the earlobe as the user desires.

Another object of the invention is to provide a multiple post earring system in which the user may utilize multiple retainer bars, one in the front of the lobe and one to the rear of the lobe, to more definitively equalize the pressure of the earring ornamentation upon the lobe so that there is additional clamping pressure to the earlobe by means of the multiple retainer bars when clamped with the friction nut clasping arrangement.

Other objects, advantages and capabilities of the invention will become apparent from the following description taken in conjunction with the accompanying drawings showing preferred embodiments of the invention.

DESCRIPTION OF THE PREFERRED EMBODIMENTS

Figure 1:
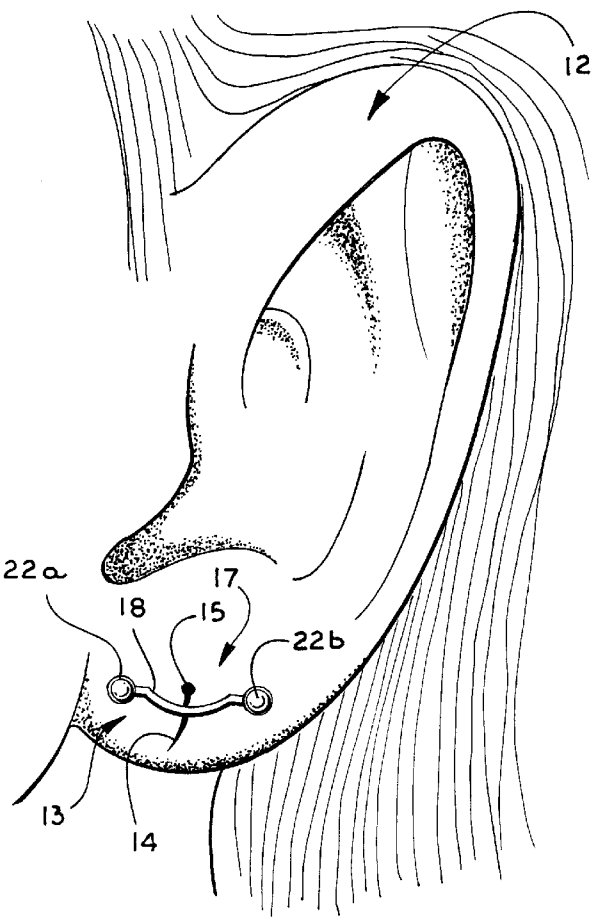
FIG. 1 shows the user's ear with the multiple post earring of the present invention shown in place, and further showing a typical type of tear in the earlobe.

Referring to the drawings wherein like reference numerals designate corresponding parts throughout the several figures, reference is first made to FIG. 1. A double post earring 11, as contemplated by the present invention, is shown mounted in the ear 12 of a user. As is common, the earring 11 is mounted in the earlobe 13 through suitable pierced holes (not shown). The concern, as previously mentioned, regarding the possibility of tearing the earlobe is graphically illustrated by a slit 14 in the earlobe which represents a substantial tear from previously using heavy earrings mounted only at a point contact with the earlobe. One can see the original pierced hole 15 at the top of the tear 14, but over time the wearing of heavy earrings has caused the original pierced hole 15 to elongate into the tear 14.

Figure 4:
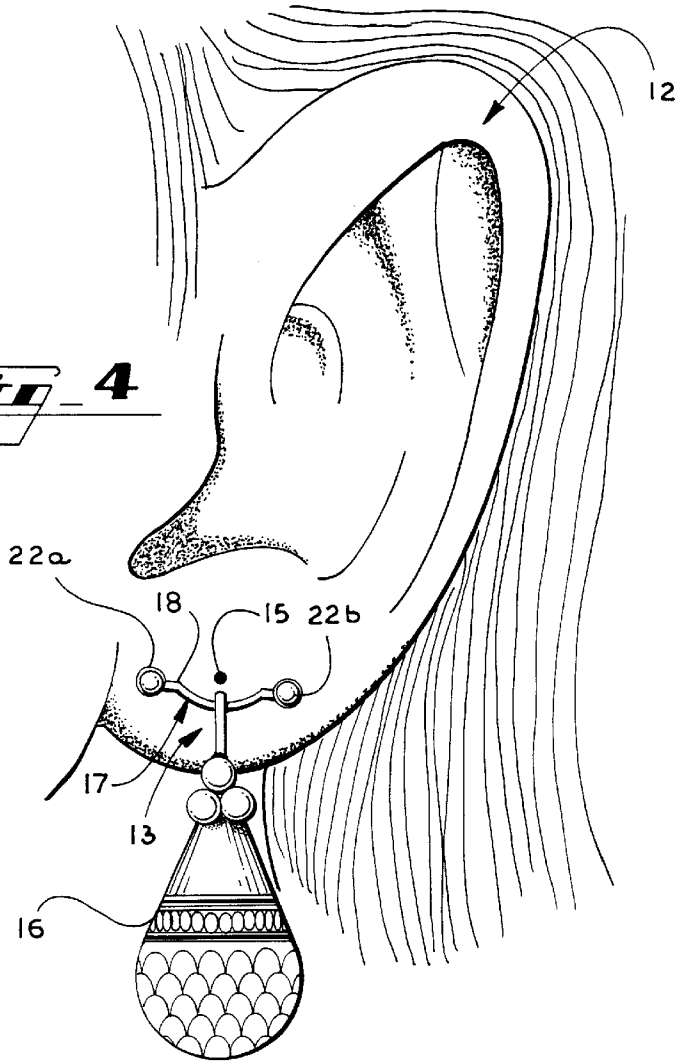
FIG. 4 shows the double post earring of the present invention with a large earring ornamentation hanging therefrom.

FIG. 4 shows the representation of the ear 12 in which the double post earring of the present invention has been properly mounted in the user's earlobe 13 prior to any tearing of the original pierced hole 15. In this case, a large earring bauble 16 is shown hanging from the double post earring 11 in such a manner that the tearing of the earlobe is quite remote. It should be noted that the user could pierce the earlobe for the pair of holes needed for the present invention in such a way that the bauble 16 could not only hang from the earring 11, but could also be placed in the pierced hole 15 for both decorative looks and for support.

Figures 2, 3, 5:
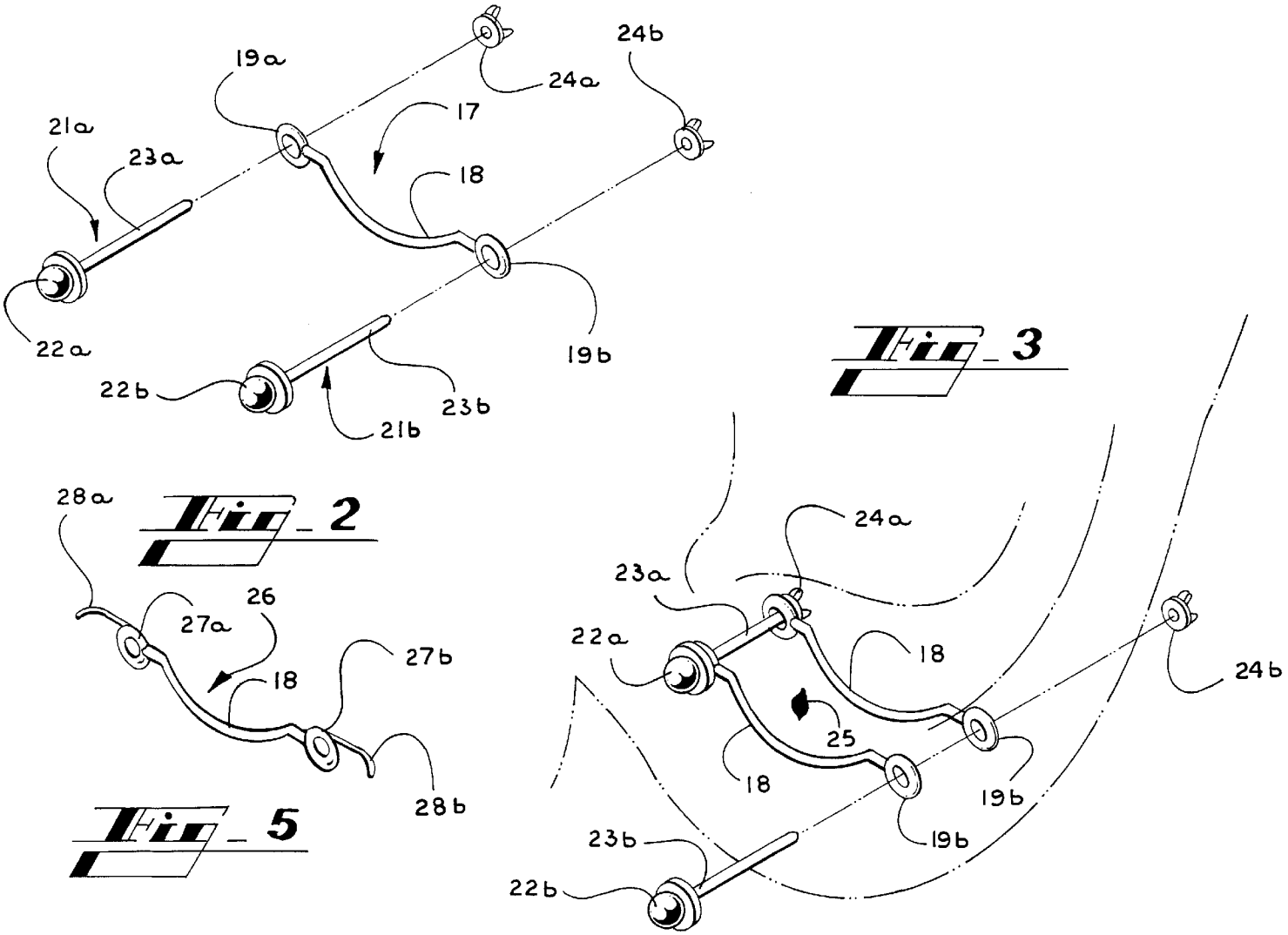
FIG. 2 is an exploded perspective view of one embodiment of the present invention.
FIG. 3 is an exploded perspective view of a second embodiment of the invention showing the double clamping arrangement around the earlobe of the user, which earlobe is shown in phantom lines.
FIG. 5 shows an alternative form of the retainer bar with decorative ornamentation thereon.

The double post earring assembly 11 of the present invention is more specifically shown in FIG. 2 and generally comprises an elongated retainer bar assembly 17 which comprises a formed bar 18 which interconnects apertures 19*a* and 19*b* shown mounted to each respective end of the bar 18. To fix the retainer bar assembly 17 to the earlobe 13, it would be anticipated that the normal procedure would be to pierce the earlobe 13 in two places, which places are identical to the spacing between apertures 19*a* and 19*b*. Once the earlobe has been pierced for the required spacing, the retainer bar assembly 17 would be placed against the earlobe, either on the front side or on the back side of the lobe, and then affixed thereto by stud assemblies 21*a* and 21*b*. Typically, the stud assemblies would have respective decorative heads 22*a* and 22*b*, and respective mounting posts 23*a* and 23*b*. To maintain the studs in the apertures 19*a* and 19*b*, and to retain the retainer bar assembly 17 to the earlobe, it would be normal to utilize respective friction nut clasps 24*a* and 24*b* on the respective posts 23*a* and 23*b*. With such an arrangement, it is easily seen that the weight of a large earring bauble 16 hanging from the bar 18 would have its weight evenly distributed over a large portion of the earlobe 13, and would not have the ability to tear the earlobe such as is indicated by numeral 14 in FIG. 1.

In another embodiment of the present invention, it is anticipated that the present invention could utilize a pair of retainer bar assemblies 17, one on the front side of the earlobe 13 and one on the back side thereof such as is shown in FIG. 3. In this manner, even heavier earring baubles 16 could be utilized on the bar 18 and the clamping pressure between the front mounted bar 18 and the rear mounted bar 18 would provide additional support with respect to the earlobe, which would gain additional mounting strength to prevent tearing and/or deformity of the earlobe. FIG. 3 also shows a pierced hole 25 which indicates the earlobe having a slight tear enlargement, and such a condition is quite prevalent with earring wearers who have started to utilize large earring baubles 16 mounted solely in one pierced hole, only to find that the pierced hole is beginning to tear and that something needs to be done to stop the tearing action. If a user already has a single pierced hole and desires to wear large earring baubles such as shown by numeral 16, that user could utilize the present invention and support the earring bauble both on the bar 18 and in the hole 25.

In FIG. 5 there is shown an alternative configuration of the retainer bar assembly 17, which alternative arrangement is indicated by numeral 26. While this bar assembly is functionally the same as bar assembly 17, it is seen that the end apertures 27*a* and 27*b* have projecting therefrom decorative members 28*a* and 28*b*. In this embodiment of the retainer bar assembly, decorative members 28*a* and 28*b* may take many shapes and configurations, but are shown herein merely for decorative purposes and not to indicate any particular function. Of course, it is obvious that the alternative retainer bar assembly 26 could be utilized with any of the embodiments previously discussed.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. An earring for mounting to the earlobe of a user through which a plurality of holes have been pierced comprising:

a retainer bar assembly having a first rigid member and a second rigid member;

each rigid member having a first end and a second end;

the first end and the second end of each rigid member forming an aperture, the first rigid member being aligned with the second rigid member and the respective first end apertures and second end apertures being aligned;

first and second stud assemblies;

the first stud assembly adapted for mounting through the first end aperture of each rigid member and the second stud assembly adapted for mounting through the second end aperture of each rigid member; and each stud assembly comprising a stud post and a clasping means to maintain the stud within the respective end aperture.

2. An earring as claimed in claim 1 wherein an ornamental member is attached to at least one of the rigid members.

3. An earring as claimed in claim 1 wherein an ornamental member is attached to both of the rigid members.

* * * * *